US006729361B2

(12) United States Patent
Noell

(10) Patent No.: US 6,729,361 B2
(45) Date of Patent: May 4, 2004

(54) METHOD FOR PACKAGING IN A CONTAINER A PRODUCT CONTAINING DIFFERENT MISCIBLE INGREDIENTS

(75) Inventor: Laurent Noell, La Ferte Bernard (FR)

(73) Assignee: Serac, La Ferte Bernard (FR)

( * ) Notice: Subject to any disclaimer, the term of this patent is extended or adjusted under 35 U.S.C. 154(b) by 0 days.

(21) Appl. No.: 10/276,059

(22) PCT Filed: May 22, 2001

(86) PCT No.: PCT/FR01/01573

§ 371 (c)(1),
(2), (4) Date: Nov. 13, 2002

(87) PCT Pub. No.: WO01/89928

PCT Pub. Date: Nov. 29, 2001

(65) Prior Publication Data

US 2003/0145901 A1 Aug. 7, 2003

(30) Foreign Application Priority Data

May 25, 2000 (FR) ..... 00 06672

(51) Int. Cl.[7] ..... B65B 3/04

(52) U.S. Cl. ..... 141/9; 141/101; 141/103; 141/104; 141/145; 141/158

(58) Field of Search ..... 141/9, 101, 103, 141/104, 145, 158

(56) References Cited

U.S. PATENT DOCUMENTS

| | | | | |
|---|---|---|---|---|
| 2,455,723 A | | 12/1948 | Ardron | |
| 5,027,869 A | * | 7/1991 | Tsumura et al. | 141/104 |
| 5,058,630 A | * | 10/1991 | Wiley et al. | 141/1 |
| 5,083,591 A | * | 1/1992 | Edwards et al. | 141/9 |
| 5,474,211 A | | 12/1995 | Hellenberg | |

FOREIGN PATENT DOCUMENTS

| | | |
|---|---|---|
| DE | 41 31 881 A1 | 7/1992 |
| EP | 0 853 041 A1 | 7/1998 |
| GB | 2178015 A | 2/1987 |

* cited by examiner

*Primary Examiner*—J. Casimer Jacyna
(74) *Attorney, Agent, or Firm*—Young & Thompson

(57) ABSTRACT

The method of packaging a receptacle (2) with a product comprising different miscible ingredients comprises the steps of filling the receptacles (2) in part with a first portion of the ingredients in a first filling unit (4) comprising a series of filling stations (5), of transferring the receptacles to at least one second filling unit likewise comprising a series of filling stations (9), and of successively finishing off the filling of the receptacles with the remainder of the ingredients.

3 Claims, 1 Drawing Sheet

METHOD FOR PACKAGING IN A CONTAINER A PRODUCT CONTAINING DIFFERENT MISCIBLE INGREDIENTS

The present invention relates to a method of packaging a receptacle with a product comprising different miscible ingredients.

BACKGROUND OF THE INVENTION

Filling installations are known, for example installations using rotary carrousels that comprise a feed vessel associated with a series of filling stations. When a product comprising a mixture of different miscible ingredients is to be introduced into the receptacles, the mixture is initially prepared with all of its ingredients and it is introduced into the feed vessel prior to putting the filling installation into operation. Such a packaging method is satisfactory when a very large number of receptacles are to be filled with a product of constant composition, and when the total volume of the filled receptacles corresponds substantially to the content of the feed vessel.

Nevertheless, when it is desired to change the composition of the product to be packaged, for example when it is desired to switch from packaging a whole milk to a semi-skimmed milk or a skimmed milk, or when packaging a product in which the properties vary as a function of the different ingredients mixed together, it is necessary initially to calculate the quantity of product that is to be introduced into the feed vessel of the installation as a function of receptacles that are to be filled, and then to clean the feed vessel and fill it with the new product that is to be packaged.

This gives rise to a significant loss of time every time the product is changed, so it is not economically conceivable to package different products in short runs, each comprising a small number of receptacles. When batches comprising receptacles containing different products need to be prepared, it is therefore necessary to package each product in a long run of receptacles which are stored and which must subsequently be handled so as to make up different batches. Those various operations significantly increase the overall cost of packaging.

U.S. Pat. No. 5,474,211 discloses a machine for making up paint to a color on demand, starting from a base tint. That machine has a single filling station and it is necessary to store pots containing the various base tints. That machine is therefore not suitable for quickly making up batches of pots of respective particular compositions.

Patent documents Nos. GB 2 178 015 and EP 0 853 041 disclose an installation comprising two filling machines interconnected by a transfer device. Nevertheless, that installation is not intended for mixing different ingredients but for packaging a single substance that tends to foam, with filling in two stages being provided merely to allow the foam to collapse prior to finishing off filling. Those documents contain no hint suggesting the use of a similar installation for packaging products of various compositions.

SUMMARY OF THE INVENTION

The invention provides a method of packaging receptacles with a product comprising different miscible ingredients, the method comprising the steps of filling receptacles partially with a portion of the ingredients in a first filling unit comprising a series of filling stations, of transferring the receptacles to at least one second filling unit likewise comprising a series of filling stations, and of successively finishing off filling of the receptacles with the remainder of the ingredients.

Thus, merely by modifying the proportions of the ingredients introduced into a receptacle at each of the filling units, and without it being necessary to modify the composition of the substance in the filling vessel in each filling unit, it is possible to obtain at the outlet from the installation receptacles that contain products with various compositions. In particular, when packaging milk, it suffices to provide two filling units, with the feed vessel of one of them containing whole milk while the feed vessel of the other filling unit contains skimmed milk, thus enabling batches of bottles to be made up comprising bottles that contain whole milk, bottles that contain semi-skimmed milk, and bottles that contain skimmed milk.

In an advantageous version of the method of the invention, the ingredients introduced into a receptacle in each filling unit are determined to correspond with the receptacle, e.g. by reading a code carried by the receptacle. Each receptacle thus automatically receives the various ingredients for making up the composition specified for that receptacle.

BRIEF DESCRIPTION OF THE DRAWING

Other characteristics and advantages of the invention will appear on reading the following description of an implementation of the method of the invention given with reference to the sole accompanying FIGURE which is a diagrammatic view of an installation enabling the method of the invention to be implemented.

MORE DETAILED DESCRIPTION

Figure 1:
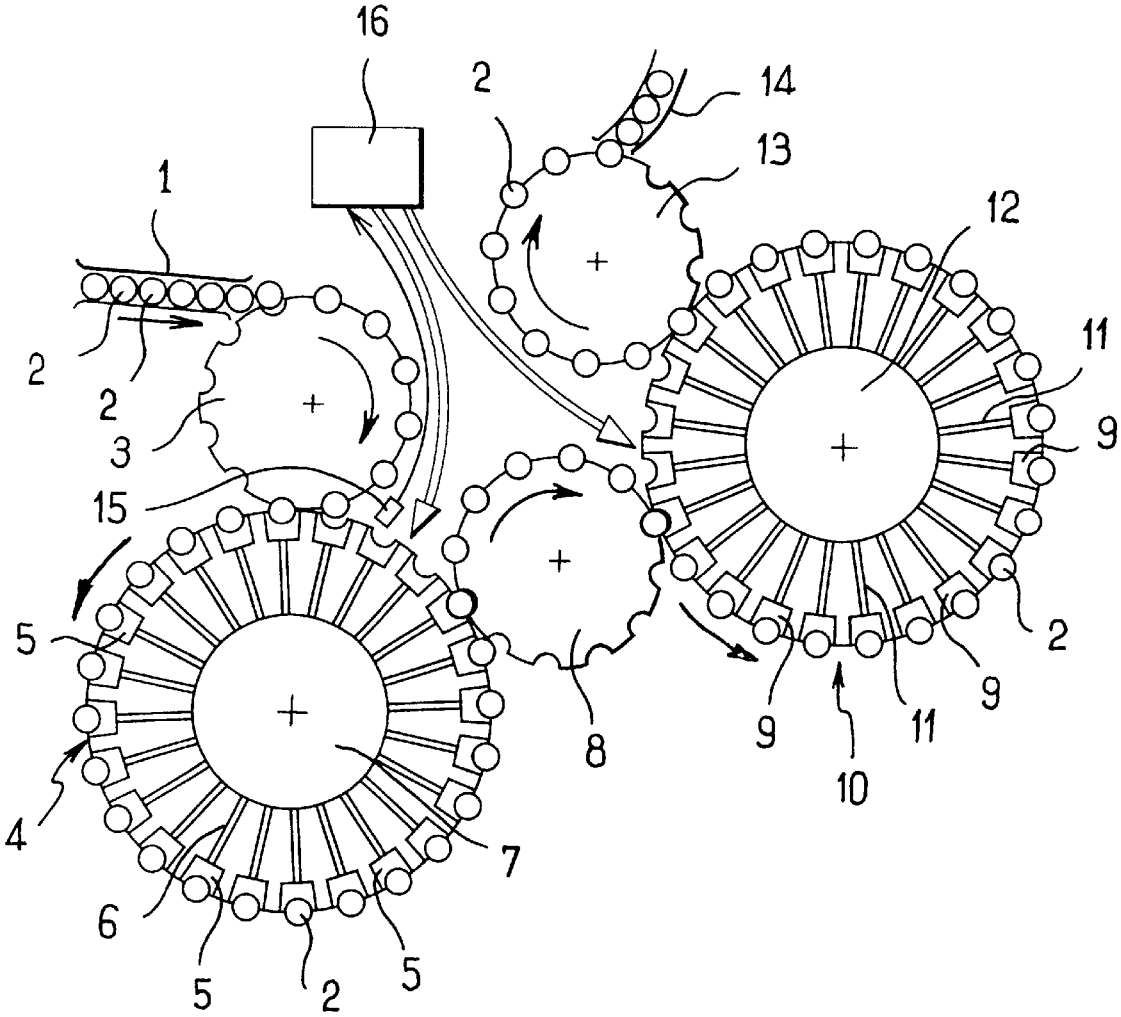

With reference to the FIGURE, the installation shown comprises an inlet conveyor 1 conveying receptacles to a transfer device 3 serving to introduce the receptacles 2 successively into a first filling unit 4 comprising a series of filling stations 5 connected by pipes 6 to a feed vessel 7.

At the outlet from the first filling station 7, the receptacles are taken up by a transfer device 8 which introduces them into a filling station 9 of a second filling unit 10 likewise comprising a series of filling stations 9 which are connected by pipes 11 to a feed vessel 12. At the outlet from the second filling unit, the receptacles 2 are taken up by a transfer device 13 which takes them to a conveyor 14 so as to bring them to the following workstation, for example a closing station or a wrapping station.

The installation shown also has a sensor 15 placed facing the receptacles at the moment they are introduced by the transfer device 3 into the first filling unit 4. The sensor 15 is connected to a control unit 16 which controls the quantity of the ingredients introduced into the receptacle in each filling station, as represented by the arrows drawn as pairs of fine lines.

When a receptacle 2 is introduced into the first filling unit, the sensor 15 detects a code carried by the receptacle, for example it reads a bar code, and it transmits the code to the control unit 16 which also receives in conventional manner information concerning the order number of the filling station 5 that is to receive the receptacle. The control unit 16 thus establishes correspondence between a receptacle and the filling station in which the receptacle is introduced. The code carried by the receptacle is representative of the composition that the receptacle is to receive, and the control unit is thus in a position to ensure that the required quantities of each substance contained in the feed vessels of the various filling units are introduced. For example, when packaging milk, it is possible to provide for the feed vessel 7 of the first filling unit 4 to contain skimmed milk while the feed vessel 12 of the second filling unit 10 contains whole milk. When the code corresponding to semi-skimmed milk is detected by the sensor 15, then the control unit 13 causes the receptacle to be half-filled only in the filling station corresponding to the first filling unit 4, with the remainder being filled in the filling station corresponding thereto in the second filling unit 10.

In this context, it should be observed that the correspondence established initially between a receptacle 2 and a filling station 5 in the first filling unit 4 is translated automatically on transfer via the transfer device 8 into correspondence between the same receptacle and a filling station 9 in the second filling unit 10.

If the bar code carried by the receptacle corresponds to skimmed milk, then the receptacle is completely filled in the first filling unit 4. In contrast, if the bar code corresponds to whole milk, then the receptacle receives nothing as it passes through the first filling unit 4 and it is completely filled as it passes through the second filling unit 10.

It will be observed that this makes it possible to make up batches containing desired numbers of receptacles for each of the compositions that can be provided by means of the installation. It is thus possible to make up directly batches that match an order from a client, for example a retailer, such that at the outlet from the filling installation batches can be made up directly for shipping purposes.

Naturally, the invention is not limited to the implementation described, and variant implementations can be applied thereto without going beyond the ambit of the invention as defined by the claims. In particular, although the invention is illustrated with respect to an implementation in which correspondence is established between a receptacle and the filling station on which it is filled by reading a bar code, it is possible to implement the method of the invention by programming the control unit 16 directly so as to fill a determined number of receptacles with a given composition and then change the composition and fill a new series of receptacles.

Although the embodiment of the installation shown has only two filling units, it is possible to adapt the number of filling units to the number of different compositions that it is desired to make from different ingredients without it being necessary to modify the nature of the substances contained in the various feed vessels. For this purpose, each feed vessel may contain either a single ingredient or a mixture of ingredients, providing the mixture is common to the various compositions. The receptacles are transferred to the various stations corresponding to the elements needed to make up a required composition, thus making it possible to finish off the filling of the receptacles with the remaining ingredients in succession.

When the receptacles carry a bar code but do not have a privileged orientation at the moment they are loaded into the filling station, it is possible to provide a plurality of sensors in order to be sure that the bar codes can be read regardless of the orientation of the receptacle.

What is claimed is:

1. A method of packaging a liquid product comprising different miscible ingredients into receptacles (2) by using a filling installation comprising at least two filling units (4, 10) of the liquid product, the method comprising the steps of simultaneously filling various receptacles (2) in part with a first portion of the ingredients in a first filling unit (4) comprising a series of filling stations (5), of transferring the receptacles to corresponding filling stations (9) of at least one second filling unit (10), and thereafter simultaneously finishing off the filling of the various receptacles with the remainder of the ingredients.

2. A method according to claim 1, wherein the ingredients introduced in each filling unit are determined in correspondence with the receptacle.

3. A method according to claim 2, wherein the correspondence with the receptacle is established by detecting a code carried by the receptacle (2).

* * * * *